US008070434B2

(12) United States Patent
Sun

(10) Patent No.: US 8,070,434 B2
(45) Date of Patent: Dec. 6, 2011

(54) FAN MOUNTING ASSEMBLY

(75) Inventor: Zheng-Heng Sun, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 501 days.

(21) Appl. No.: 12/354,782

(22) Filed: Jan. 16, 2009

(65) Prior Publication Data

US 2010/0143150 A1 Jun. 10, 2010

(30) Foreign Application Priority Data

Dec. 4, 2008 (CN) ..... 2008 1 0305962

(51) Int. Cl.

| | |
|---|---|
| ***F01D 25/26*** | (2006.01) |
| ***F01D 25/28*** | (2006.01) |
| ***F03B 11/00*** | (2006.01) |
| ***F03D 11/04*** | (2006.01) |
| ***F04D 29/60*** | (2006.01) |

(52) U.S. Cl. ..... 415/213.1; 415/214.1; 415/121.2; 416/244 R; 416/247 R; 416/246

(58) Field of Classification Search ..... 415/121.2, 415/213.1, 214.1, 220; 416/246, 244 R, 416/247 R See application file for complete search history.

(56) References Cited

U.S. PATENT DOCUMENTS

| | | | | |
|---|---|---|---|---|
| 6,071,078 | A * | 6/2000 | Schlegel et al. | 416/247 R |
| 6,682,308 | B1 * | 1/2004 | Fei et al. | 416/246 |
| 6,690,576 | B2 * | 2/2004 | Clements et al. | 361/695 |
| 6,981,678 | B2 * | 1/2006 | Fu-Liang | 248/343 |
| 7,530,783 | B1 * | 5/2009 | Ediger | 415/121.2 |
| 7,599,179 | B2 * | 10/2009 | Chen et al. | 361/679.48 |
| 7,697,287 | B2 * | 4/2010 | Yin | 361/695 |

* cited by examiner

*Primary Examiner* — David Nhu
(74) *Attorney, Agent, or Firm* — Altis Law Group, Inc.

(57) ABSTRACT

A fan mounting assembly includes a fan, a supporting device, two fixing devices, and two magnetic units. The fan includes a frame having two spaced walls, and at least two spaced fixing holes are defined in each of the walls. The fixing devices are oppositely mounted to the supporting device and sandwich the fan therebetween. Each of the fixing devices includes a fixing plate and two fixing arms perpendicular to the fixing plate. The fixing arms of the fixing devices are made of ferromagnetic material and align with the fixing holes of the fan respectively. Each of the magnetic units includes two magnets. Each magnet of the magnetic units engages in a corresponding one of the at least two fixing holes of a corresponding wall of the fan and attracts a corresponding fixing arm, to make the fixing arms clamp the fan.

15 Claims, 3 Drawing Sheets

FAN MOUNTING ASSEMBLY

CROSS-REFERENCE TO RELATED APPLICATION

This application claims priority under 35 U.S.C. 119 from Chinese patent application No. 200810305962.2, filed on Dec. 4, 2008, which is incorporated by reference herein as if fully set forth.

BACKGROUND

1. Technical Field

The present disclosure relates to mounting assemblies and, especially, to a fan mounting assembly.

2. Description of Related Art

When testing an electronic device, such as a motherboard, a fan is placed beside the electronic device to dissipate heat produced by components of the electronic device. However, the fan is apt to be knocked down or moved by vibrations or careless handling.

DETAILED DESCRIPTION

Figure 1:
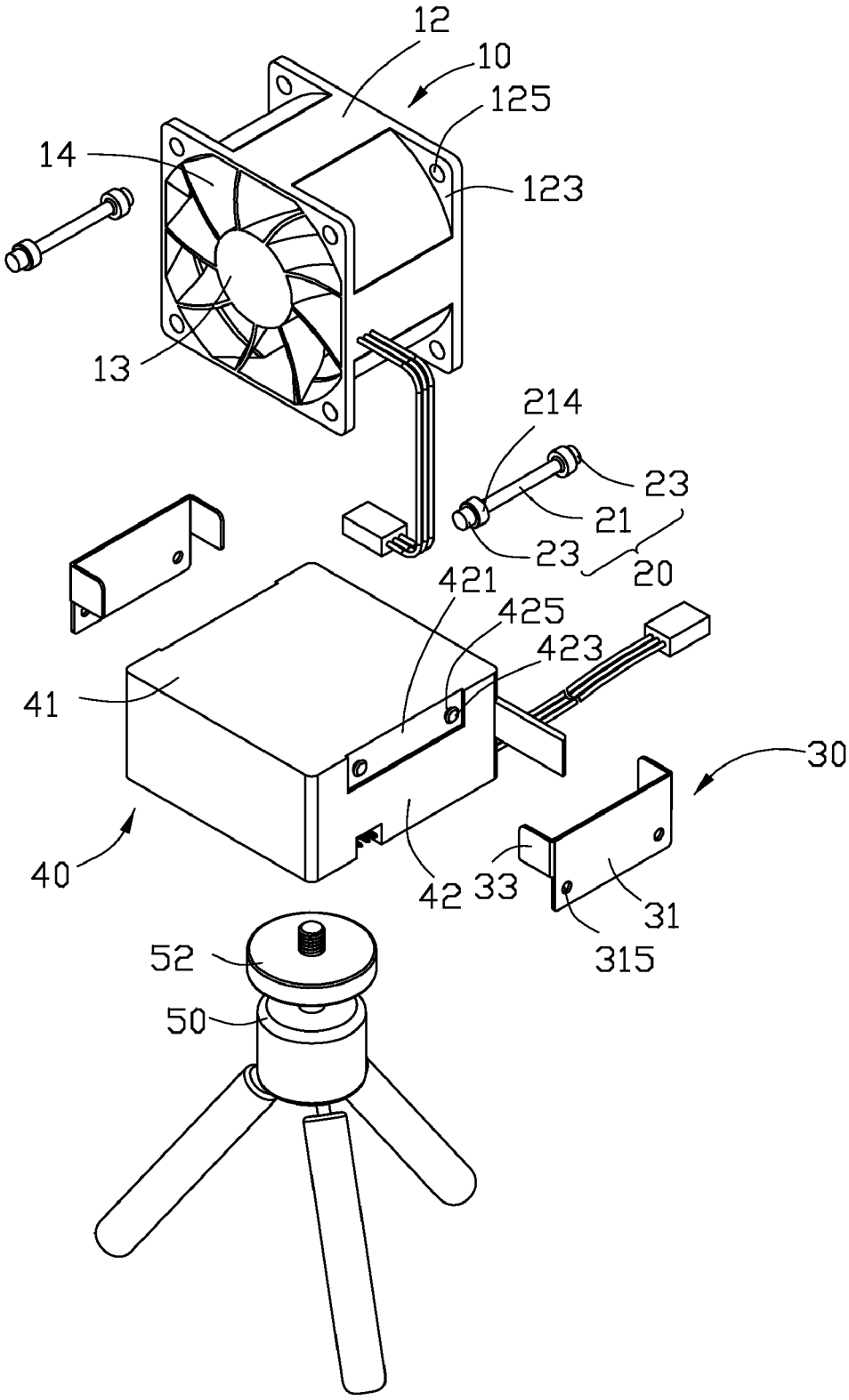
FIG. 1 is an exploded, isometric view of one embodiment of a fan mounting assembly.

Referring to FIG. 1, one exemplary embodiment of a fan mounting assembly includes a fan 10, two magnetic units 20, two fixing devices 30, and a supporting device 40.

The fan 10 includes a frame 12, a hub 13 installed in the frame 12, and a plurality of vanes 14 extending from the hub 13. The frame 12 includes two spaced parallel walls 123 at two ends of the hub 13. Four pairs of aligned fixing holes 125 are defined in the walls 123 adjacent to four corners of the frame 12, respectively.

Each magnetic unit 20 includes a connecting post 21 and two magnets 23. The connecting post 21 is made of plastic material or other flexible material. Two receiving portions 214 are formed on two ends of the connecting post 21, respectively. Each receiving portion 214 defines a recess opposite to the connecting post 21, and the corresponding magnet 23 is fixed to the recess by adhering means or other engaging means.

Each fixing device 30 includes a fixing plate 31. Two fixing arms 33 perpendicularly extend from upper portions of opposite ends of the fixing plate 31, respectively, in the same direction. Two through holes 315 are defined in lower portions of the opposite ends of the fixing plate 31. The fixing arms 33 are made of iron or other ferromagnetic material.

The supporting device 40 includes a top wall 41, and two sidewalls 42 perpendicularly extending down from opposite sides of the top wall 41. A concave portion 421 is defined in an upper section of each sidewall 42 adjoining the top wall 41. Two resilient protrusions 423 protrude from each concave portion 421, and a groove 425 is defined in a circumference of each protrusion 423 adjacent to the corresponding sidewall 42.

Figure 2:
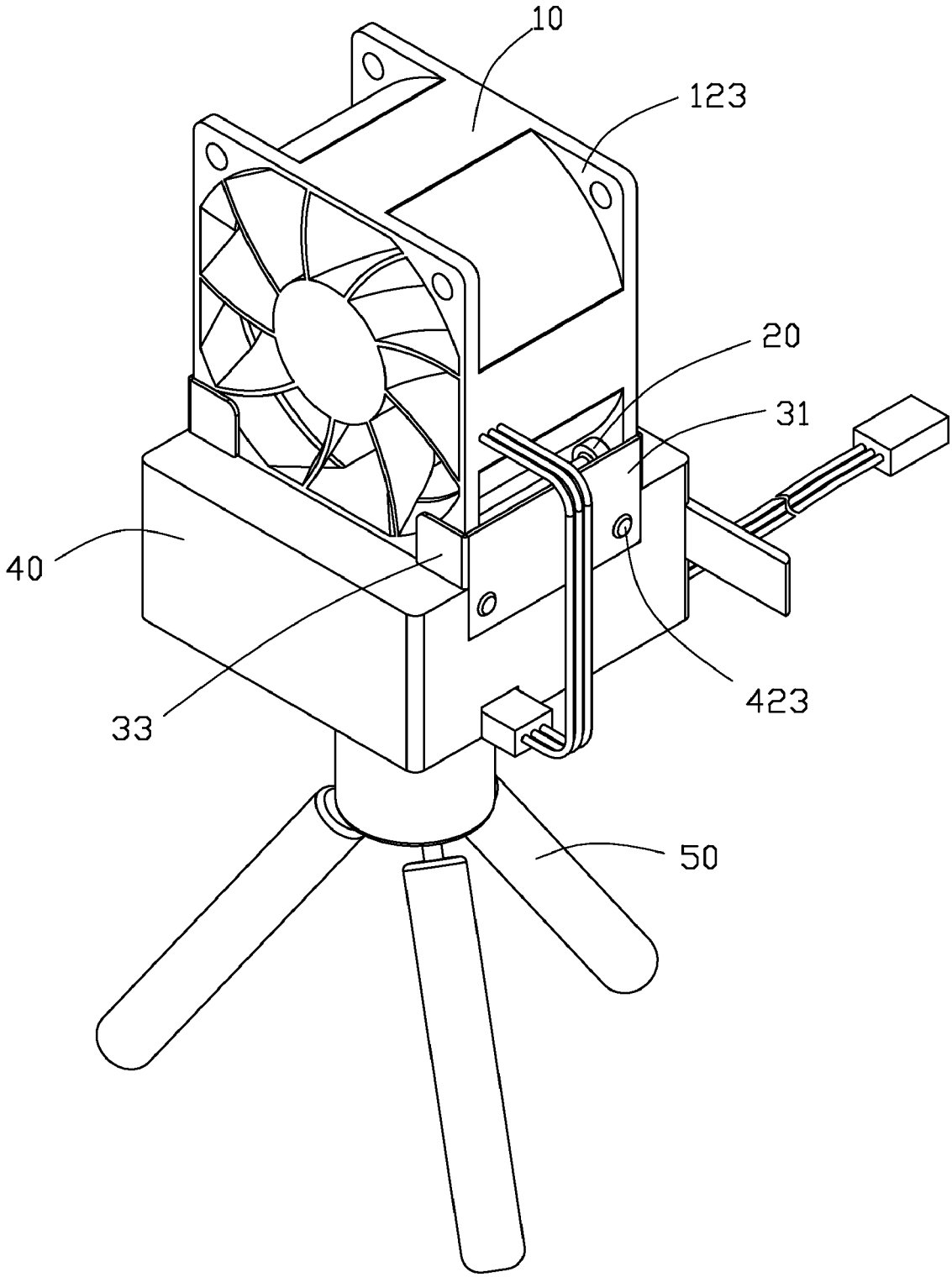
FIG. 2 is an assembled view of the mounting assembly of FIG. 1.

Referring to FIG. 2, in assembly, the fixing devices 30 are respectively mounted to the concave portions 421 of the supporting device 40, with the protrusions 423 on each concave portion 421 extending through the through holes 315 of the corresponding fixing device 30, and the portions bounding the through holes 315 of the fixing device 30 respectively engaging in the grooves 425 of the corresponding protrusions 423. Bottoms of the fixing plates 31 of the fixing devices 30 abut against bottom walls of the concave portions 421, respectively, and the fixing arms 33 of the fixing devices 30 are supported on the top wall 41 of the supporting device 40. The magnets 23 are respectively fixed to the receiving portions 214 of the connecting posts 21. The connecting posts 21 are bent to allow the magnets 23 to respectively engage in two adjacent pairs of aligned fixing holes 125 of the walls 123 of the fan 10. The connecting posts 21 are perpendicular to the walls 123. The fan 10 is placed on the supporting device 40 and sandwiched between the fixing devices 30. Two opposite sides of the fan 10 abut against the fixing plates 31 of the fixing devices 30, and the walls 123 of the fan 10 abut against the fixing arms 33 of the fixing devices 30. The fixing arms 33 align with the magnets 23 installed on the fan 10, respectively, and are attracted by the magnets 23 to tightly clamp the fan 10.

In use, the supporting device 40 can be installed on a rotating device 52 of a tripod 50. Thereby, the fan 10 installed on the tripod 50 can be easily adjusted to a desired direction.

Figure 3:
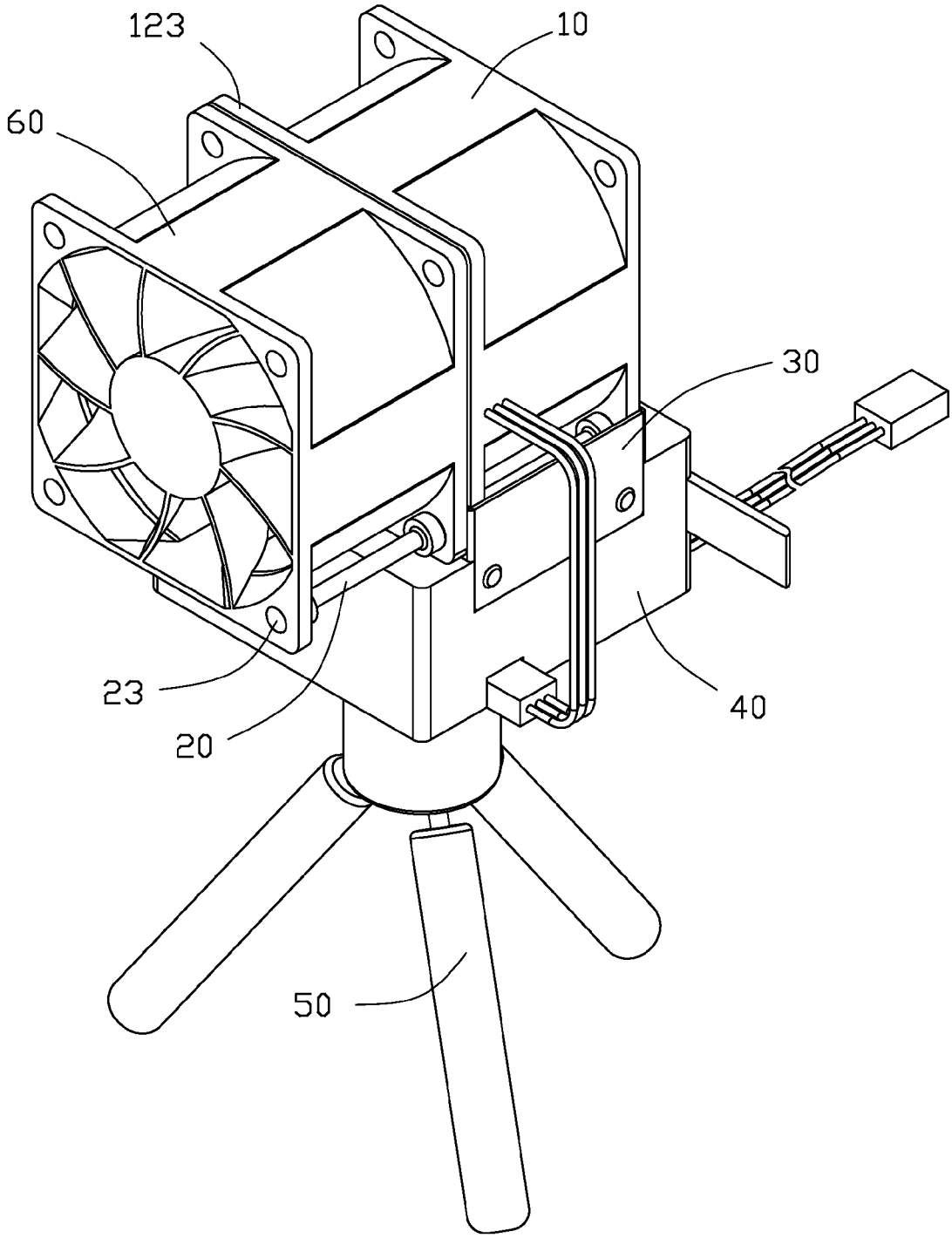
FIG. 3 is similar to FIG. 2, but with another fan added to the assembly.

Referring to FIG. 3, a second fan 60 having two magnetic units 20 installed thereon is added to be attracted to the outside of one of the walls 123 of the fan 10 via magnetic force of the magnets 23 of the fans 10, 60, to improve the heat dissipating effect. Furthermore, the outside of the other one of the walls 123 of the fan 10 can also attract a third fan having two magnetic units 20 installed thereon.

In another embodiment, the connecting post 21 of each magnetic unit 20 can be omitted. Therefore, each magnetic unit 20 would include two magnets 23, and the magnets 23 are fixed to the corresponding fixing holes 125 of the fan 10 by adhering means or other engaging means.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being exemplary embodiments of the disclosure.

What is claimed is:

1. A fan mounting assembly comprising:

a fan comprising a frame, the frame comprising two spaced walls, wherein two pairs of fixing holes are defined in the two spaced walls, two fixing holes of each pair of fixing holes are aligned with each other; and a supporting device comprising a top wall for supporting the fan, and two sidewalls extending from opposite sides of the top wall;

two fixing devices each comprising a fixing plate, and two fixing arms extending from upper portions of two opposite ends of the fixing plate, the fixing plates mounted to the two sidewalls of the supporting device respectively with the fixing arms located above or on the top wall of the supporting wall, the fixing arms being made of ferromagnetic material and aligning with the fixing holes of the fan respectively, wherein the fixing plates sandwich the fan therebetween, and the fixing arms sandwich the fan therebetween; and two magnetic units each comprising two magnets, wherein the two magnets of the magnetic units are fixed to the fixing holes of the fan to attract the two fixing arms to clamp the fan.

2. The fan mounting assembly of claim 1, wherein each of the magnetic units further comprises a connecting post made of flexible material, the two magnets are fixed to opposite ends of the connecting post, the connecting posts are perpendicularly arranged between the two spaced walls of the fan, and the two magnets on each of the connecting posts are fixed to one pair of fixing holes of the two spaced walls.

3. The fan mounting assembly of claim 2, wherein the flexible material is plastic material.

4. The fan mounting assembly of claim 2, wherein two receiving portions are formed on the opposite ends of each of the connecting posts, each of the receiving portions defines a recess opposite to the corresponding connecting post, and the two magnets are fixed to the recesses by adhering means or engaging means.

5. The fan mounting assembly of claim 1, wherein the two magnets are fixed to the corresponding fixing holes of the fan by adhering means or engaging means.

6. The fan mounting assembly of claim 1, wherein a concave portion is defined in an upper section of each of the sidewalls adjoining the top wall, two resilient protrusions protrude from each concave portion, a groove is defined in a circumference of each of the protrusions adjacent to the corresponding sidewall, and two through holes are defined in a lower portion of each of the fixing plates, to respectively engage in the grooves of the protrusions.

7. The fan mounting assembly of claim 1, further comprising a tripod, the tripod comprising a rotating device, wherein the supporting device is installed on the rotating device of the tripod and rotatable together with the rotating device.

8. A fan mounting assembly comprising:

a fan comprising a frame, the frame comprising two spaced walls, wherein at least two spaced fixing holes are defined in each of the two spaced walls; and a supporting device;

two fixing devices oppositely mounted to the supporting device and sandwiching the fan therebetween, each of the two fixing devices comprising a fixing plate and two fixing arms perpendicular to the fixing plate, the fixing arms of the fixing devices being made of ferromagnetic material and aligning with the two spaced fixing holes of the fan respectively; and two magnetic units, each of the two magnetic units comprising two magnets, each magnet of the magnetic units engaging in a corresponding one of the at least two spaced fixing holes of a corresponding wall of the fan and attracting a corresponding fixing arm, to make the corresponding fixing arms to clamp the fan.

9. The fan mounting assembly of claim 8, wherein the at least two fixing holes of one of the walls align with the at least two fixing holes of the other one of the walls, each of the two magnetic units further comprises a connecting post made of flexible material, and the magnets are fixed to opposite ends of the connecting posts.

10. The fan mounting assembly of claim 9, wherein the flexible material is plastic material.

11. The fan mounting assembly of claim 9, wherein two receiving portions are formed on the opposite ends of each of the connecting posts, each of the two receiving portions defines a recess opposite to the corresponding connecting post, and the two magnets are fixed to the recesses by adhering means or engaging means.

12. The fan mounting assembly of claim 8, wherein the two magnets engage in the corresponding fixing holes of the fan by adhering means.

13. The fan mounting assembly of claim 8, wherein the supporting device comprises a top wall and two opposite sidewalls, a concave portion is defined in an upper section of each of the sidewalls adjoining the top wall, two resilient protrusions protrude from each concave portion, a groove is defined in a circumference of each of the protrusions adjacent to the corresponding sidewall, and two through holes are defined in a lower portion of each of the fixing plates, to respectively engage in the grooves of the protrusions.

14. The fan mounting assembly of claim 8, further comprising a tripod, the tripod comprising a rotating device, wherein the supporting device is installed on the rotating device of the tripod and rotatable together with the rotating device.

15. The fan mounting assembly of claim 8, further comprising a second fan comprising a magnet unit, wherein the second fan is attached to one of the spaced walls of the fan via magnetic forces of the magnet unit of the second fan and of the magnet units of the fan.

* * * * *